US006412940B1

(12) United States Patent
Inoue et al.

(10) Patent No.: US 6,412,940 B1
(45) Date of Patent: Jul. 2, 2002

(54) INK-JET RECORDING METHOD, AND INK-JET PRINTER

(75) Inventors: Hiroshi Inoue; Yoshiro Yamashita; Takatsugu Doi; Ken Hashimoto, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/650,666

(22) Filed: Aug. 30, 2000

(30) Foreign Application Priority Data

Sep. 29, 1999 (JP) ..... 11-275888

(51) Int. Cl.[7] ..... B41J 2/01
(52) U.S. Cl. ..... 347/101; 347/100; 347/105
(58) Field of Search ..... 347/100, 105, 347/101, 99; 428/195

(56) References Cited

U.S. PATENT DOCUMENTS 5,908,728 A * 6/1999 Sakaki et al. ..... 347/105
6,180,238 B1 * 1/2001 Malhotra ..... 428/195

FOREIGN PATENT DOCUMENTS

| | | |
|---|---|---|
| JP | 6-157955 | 6/1994 |
| JP | 8-310111 | 11/1996 |
| JP | 9-234946 | 9/1997 |
| JP | 10-278413 | 10/1998 |

* cited by examiner

*Primary Examiner*—John Barlow
*Assistant Examiner*—M Shah
(74) *Attorney, Agent, or Firm*—Morgan, Lewis & Bockius LLP

(57) ABSTRACT

The present invention provides an ink-jet recording method and an ink-jet printer, which can diminish or control curling and cockling of the recording medium. The present invention also provides an ink-jet recording method and an ink-jet printer, which can form a recorded image of high quality, resistance to water and drying capacity, while diminishing or controlling curling and cockling. In the ink-jet recording method and ink-jet printer of the present invention, a recording image is formed on the surface of a recording medium containing at least one organic compound selected from the group consisting of 1,1,1-tris(hydroxylmethyl)propane, monosaccharides, oligosaccharides, and sugar alcohols, by applying an ink composed of at least a colorant, a water-soluble organic solvent, and water.

6 Claims, No Drawings

INK-JET RECORDING METHOD, AND INK-JET PRINTER

BACKGROUND OF THE INVENTION

1. Field of the Invention

The present invention relates to an ink-jet recording method that ejects ink for recording an image, and an ink-jet printer.

2. Discussion of the Related Art

The so-called ink-jet type printer, which ejects liquid or molten solid ink via a nozzle, slit, porous film or the like onto paper, cloth, film or the like for recording, has various advantages, such as compactness, low price, quietness. These apparatuses falling into this type have been recently used widely, not only for monochromic printers printing high-quality letters or images on common paper, e.g., reporting paper and copy paper, but also for full-color printing, holding an important position in the area of printers. In particular, so-called piezo ink-jet type, which uses piezoelectric device, and thermal ink-jet type, which uses thermal energy to form ink droplets, have various advantages, e.g., high-speed printing and high resolution of the printed letters or the like.

The ink for ink-jet printers is mainly composed of a solvent, colorant, and one or more additives. It is required for such an ink to satisfy the following characteristics:

(1) The letters and images it gives are free of bleeding or fogging, and high in resolution, concentration and uniformity.
(2) It is not dried at the nozzle tip to prevent clogging there, and high in ink discharge response and stability.
(3) It is quickly dried on paper onto which it is ejected.
(4) It gives durable letters and images.
(5) It is stably stored for extended periods.

More recently, another requirement (6) has been added; it can diminish or control curling and cockling of the recording medium, more noted when common paper is printed. Curling means a phenomenon in which paper is rounded during or after printing, and cockling means partial creasing appearing during or after printing.

The curled media are difficult to put one on another, to expand into a sheet, and hence difficult to handle. On the other hand, cockling occurring during printing may cause friction between the ink-jet recording head and medium, possibly deteriorating image quality. Curling and cockling can cause more serious problems, when color graphics images, which are frequently solid-printed, are continuously printed at a high speed, e.g., around 5 ppm and especially 10 ppm or higher. They also prevent smooth printing on both sides. Therefore, diminishing or controlling curling and cockling of recording media is increasingly demanded.

One of the methods for controlling curling is use of a curling inhibitor, e.g., 1,3-diols, 1,3,5-triols and amino-1,3-diols, as disclosed by Japanese Patent Laid-Open No. 6-157955 (1994). This method, although controlling curling, is not highly satisfactory, because of several possible problems resulting from incorporation of a large quantity of the inhibitor in the ink, e.g., deteriorated image quality, nozzle clogging and decreased reliability of the printer.

Another technique proposed to control curling is treating a recording medium. Treating the medium enhances ink reliability and design freedom. For example, Japanese Patent Laid-Open No. 8-310111 (1996) discloses a method for providing a back coat layer on a recording medium opposite to the ink-receiving layer. Japanese Patent Laid-Open No. 9-234946 (1997) discloses a recording medium of common paper type, which limits irreversible shrinkage in the MD and CD directions, when relative humidity is changed. Japanese Patent Laid-Open No. 10-278413 (1998) discloses a method for limiting curl size extent on the coat layer and the opposite side. These conventional techniques do improve resistance of the medium to curling, although still to an insufficient extent, and are more insufficient with respect to improvement of resistance to cockling, image quality and resistance to water.

SUMMARY OF THE INVENTION

The present invention has been made in view of the above circumstances and provides an ink-jet recording method and an ink-jet printer, which can diminish or control curling and cockling of a recording medium.

The present invention also provides an ink-jet recording method and an ink-jet printer, which can form a recorded image of high quality, resistance to water and drying capacity, while diminishing or controlling curling and cockling.

The inventors of the present invention have found, after having extensively studied, that the medium curls, when printed with 1,1,1-tris(hydroxylmethyl)propane, a monosaccharide, oligosaccharide or sugar alcohol alone, in a direction opposite to that observed when it is printed with water alone, and that the above-described objects can be achieved by applying the above effect to an ink-jet recording method and an ink-jet printer, reaching the present invention.

The ink-jet recording method of the present invention forms a recorded image on a recording medium containing at least one organic compound selected from the group consisting of 1,1,1-tris(hydroxylmethyl)propane, monosaccharides, oligosaccharides, and sugar alcohols with an ink composed of at least a colorant, water-soluble organic solvent, and water.

It is accepted that the curling and cockling phenomena are, in general, greatly affected by adsorption and evaporation of water in inter-cellulose void in paper. When printed with an aqueous ink, paper generally curls in the direction toward the printed face. However, paper curls in the opposite direction, when printed with any organic compound selected from 1,1,1-tris(hydroxylmethyl)propane, monosaccharides, oligosaccharides, and sugar alcohols alone (each of these compound is hereinafter referred to as a [specific organic compound]). This phenomenon is hereinafter referred to as [curling in the opposite direction].

It is therefore expected that a recording medium can be prevented from being curled or cockled, when it is incorporated beforehand with a specific organic compound, in accordance with teaching of the present invention, because the ink-caused curling effect and curling effect in the opposite direction by the specific organic compound offset each other. It is also expected, when paper is used as the recording medium, that a specific organic compound works to control curling and cockling of the printed medium by penetrating into the inter-cellulose voids to control adsorption and evaporation of water derived from the ink.

The ink-jet recording method of the present invention can control curling and cockling of the recording medium, particularly efficiently for full-color image recording, where images are printed over a wide area, frequently on almost entire surface, of the medium. It can also control curling and cockling of the medium even for monochromic printing, when solid images are printed over a certain area of the medium.

It is preferable that the above-described recording medium and ink are further incorporated with a cationic substance and an anionic substance, respectively, in order to further diminish or control curling and cockling of the medium. It is considered, although not fully substantiated, that incorporation of cationic and anionic substances promotes interactions between the medium and ink to adequately retard penetration of the ink into the medium and thereby to further diminish or control curling and cockling efficiently and effectively. Moreover, the ionic interactions between the medium and ink promote separation and agglomeration of the dye or pigment, further improving the quality and water resistance of the image.

The above-described cationic substance is preferably at least one selected from the group consisting of cationic surfactants, cationic polymers and multivalent metallic salts. The above-described anionic substance is preferably an aqueous dye having an anionic group, more preferably an anionic compound.

It is preferable that the recording medium for the present invention further contains fine, inorganic particles, preferably of silicon dioxide and/or calcium carbonate. Incorporation of the inorganic particles further improves medium drying capacity and image quality.

The ink-jet printer of the present invention for the ink-jet recording method of the present invention, provided with a transfer device that transfers a recording medium, an ink-jet recording head that ejects an ink onto the medium transferred by the transfer device to form an image thereon, and an image signal inputting device that inputs an image signal to the ink-jet recording head, wherein the above-described recording medium contains at least one organic compound selected from the group consisting of 1,1,1-tris(hydroxylmethyl)propane, monosaccharides, oligosaccharides, and sugar alcohols, and the above-described ink is composed of at least a colorant, a water-soluble organic solvent and water can diminish or control curling and cockling of the printed medium.

The ink-jet printer of the present invention can more efficiently control curling and cockling of the medium and further improve image quality and resistance of the medium to water, when the recording medium and ink contain a cationic substance and an anionic substance, respectively.

DETAILED DESCRIPTION OF THE PREFERRED EMBODIMENTS

The present invention is described in detail.

Recording Medium

First, the recording medium for the present invention is described.

1. Constitution of the Recording Medium (Specific Organic Compound)

The recording medium for the present invention contains at least one organic compound selected from the group consisting of 1,1,1,-(hydroxylmethyl)propane, monosaccharides, oligosaccharides, and sugar alcohols.

More concretely, the monosaccharides useful for the present invention include D- and L-fructose, tagatose, sorbose, ribose, xylose, arabinose, lyxose, glucose, mannose, allose, altrose, gulose, idose, galactose, talose and glose.

The oligosaccharides useful for the present invention include maltose, cellobiose, trehalose, gentiobiose, isomaltose, lactose, sucrose, saccharose, raffinose, gentianose, stachyose and xylan.

The sugar alcohols useful for the present invention include tetrytol, D-erythritol, L-erythritol, D-arabinitol, L-arabinitol, xylitol, adonitol, ribitol, D-sorbitol, allitol, D-mannitol, D-iditol, D-talitol, dulcitol, heptitol.

The specific organic compounds particularly useful for the present invention are 1,1,1-tris(hydroxylmethyl) propane, D- and L-glucose, and xylitol.

These specific organic compounds may be used either individually or in combination.

The specific organic compound is present in the recording medium preferably at 0.5 to 50 g/m$^2$, more preferably 5 to 30 g/m$^2$.

(Cationic Substance)

The recording medium for the present invention preferably contains a cationic substance, as described earlier. The "cationic substance" useful for the present invention is the one dissociated in water into cation, e.g., a multivalent metallic salt or organic cation. More concretely, the preferable cationic substances include cationic surfactants, cationic polymers and multivalent metallic salts.

The cationic surfactants useful for the present invention include tetraalkyl ammonium, alkyl amine, benzalkonium, alkyl pyridinium and imidazolium salts, and their derivatives, e.g., dihydroxyethyl stearyl amine, 2-heptadecenyl-hydroxyethyl imidazoline, lauryl dimethylbenzyl ammonium chloride, cetylpyridinium chloride, stearamide methyl pyridinium chloride, hexadecyl trimethyl ammonium chloride, hexadecyl trimethyl ammonium bromide, hexadecyl dimethylamine hydrochloride, hexadecyl pyridinium chloride, stearyl amine EO-added hydrochloride, and distearyldimethyl ammonium chloride.

These cationic surfactants may be used either individually or in combination. The cationic surfactant is present in the recording medium preferably at 0.1 to 20 g/m$^2$, more preferably 1 to 10 g/m$^2$.

The cationic polymers useful for the present invention include polyallyamine, polyamine sulfone, polyethyleneimine, polyvinyl amine, polyalkylene-polyamine, polyvinyl imidazoline, chitosan, and these compounds totally or partially neutralized with an acid (e.g., hydrochloric or acetic acid); and diethylene/triamine condensate, N,N-bisaminopropyl ethylenediamine, diallyldimethyl ammonium chloride/sulfur dioxide copolymer, and perfluoroalkyl ammonium chloride.

These cationic polymers may be used either individually or in combination. The cationic polymer is present in the recording medium preferably at 0.5 to 30 g/m$^2$, more preferably 2 to 15 g/m$^2$.

The multivalent metallic salt is composed of a divalent or higher metallic ion and an anion bonded thereto. The multivalent metallic salts useful for the present invention are those soluble in water. More concretely, the multivalent metallic ions include calcium, copper, nickel, magnesium, zinc, barium, iron, aluminum and chromium ions. The anions include chloride, iodide, bromide, nitrate, sulfate, sulfite, phosphate, chlorate and acetate ions.

The concrete examples of the multivalent metallic salts include aluminum chloride, aluminum bromide, aluminum sulfate, aluminum nitrate, aluminum acetate, barium chloride, barium bromide, barium iodide, barium nitrate, calcium chloride, calcium bromide, calcium iodide, calcium nitrate, calcium acetate, copper chloride, copper bromide, copper sulfate, copper nitrate, copper acetate, iron chloride, iron bromide, iron iodide, iron sulfate, iron nitrate, magnesium chloride, magnesium bromide, magnesium iodide, magnesium sulfate, magnesium nitrate, magnesium acetate, nickel chloride, nickel bromide, nickel sulfate, nickel nitrate, nickel acetate, zinc chloride, zinc bromide, zinc sulfate, zinc nitrate, and zinc acetate.

These multivalent metallic salts may be used either individually or in combination. The multivalent metallic salt is present in the recording medium preferably at 0.1 to 20 $g/m^2$, more preferably 1 to 10 $g/m^2$.

(Fine Inorganic Particles)

It is preferable, as described earlier, that the recording medium for the present invention is incorporated with fine inorganic particles. The examples of these particles are those used as fillers and coatings for paper. More concretely, these particles are of silicon dioxide, calcium carbonate, magnesium carbonate, talc and clay, of which silicon dioxide and calcium carbide are more preferable. They may be used either individually or in combination.

These particles are preferably 3 $\mu$m or less in size, more preferably 0.1 to 1 $\mu$m. They are present in the recording medium preferably at 0.5 to 20 $g/m^2$, more preferably 2 to 10 $g/m^2$.

(Recording Medium Base)

The recording medium for the present invention comprises a base which is incorporated with the above-described components. The recording medium bases useful for the present invention include common paper, acidic paper, coated paper, and postcard.

2. Production of Recording Medium

The recording medium for the present invention is incorporated, as described earlier, with the specific organic compound, and, as required, a cationic substance and fine inorganic particles. The recording medium base may be impregnated with these components, or they may be spread over the image-recording face. They may be contained in the medium, when it is coated paper.

The recording medium base can be impregnated with the specific organic compound, and, as required, a cationic substance and fine inorganic particles by incorporating these components in the base during the paper-making process, or by immersing the base in a solution of these components dissolved in a solvent, e.g., water.

When the specific organic compound, and, as required, a cationic substance and fine inorganic particles are to be spread over the image-recording face of the base, a coating solution of these components dissolved in a solvent, e.g., water can be spread over the face by an adequate method, e.g., dip, roller, brush, flow, spray, ink-jet or static electricity coating.

When coated paper is used as the recording medium base, it may be coated after being incorporated with the above-described components during the paper-making process.

Contents of the specific organic compound, and, as required, a cationic substance and fine inorganic particles in the immersion solution, coating solution or coating material are adequately set in a desired range for each component, after taking into consideration the conditions of, e.g., immersion or coating process.

[Ink]

The ink for the present invention is described.

1. Ink Composition (Aqueous Organic Solvent)

The aqueous organic solvents useful for the ink for the present invention include polyhydric alcohols, e.g., ethylene glycol, diethylene glycol, propylene glycol, butylene glycol, triethylene glycol, 1,5-pentanediol, 1,2,6-hexanetriol, glycerin; polyhydric alcohol derivatives, e.g., ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, diethylene glycol monohexyl ether, triethylene glycol monobutyl ether, propylene glycol monobutyl ether, and dipropylene glycol monobutyl ether; nitrogen-containing solvents, e.g., pyrrolidone, N-methyl-2-pyrrolidone, cyclohexyl pyrrolidone, and triethanolamine; alcohols, e.g., ethanol, isopropyl alcohol, butyl alcohol, and benzyl alcohol; sulfur-containing solvents, e.g., thiodiethanol, thiodiglycerol, sulfolane, and dimethyl sulfoxide; and other compounds, e.g., propylene carbonate, ethylene carbonate, 1,1,1-tris(hydroxymethyl)propane, monosaccharides, oligosaccharides, sugar alcohol.

These aqueous organic solvents may be used either individually or in combination. Content of the aqueous organic solvent in the ink for the present invention is not limited, but it is preferably 1 to 60 wt. %, based on the whole ink, more preferably 5 to 40 wt. %.

(Water)

Any type of common water can be used for the ink for the present invention. It is however preferable to use ion-exchanged, superpure, distilled or ultrafiltration-treated water, to prevent contamination with impurities.

(Colorant)

The colorants useful for the ink for the present invention may be dyes or pigments.

The dyes useful for the ink for the present invention include direct, acid, edible, basic, reactive, dispersed, vat, soluble vat, reactive dispersed and fat dyes. The preferable ones for the present invention are water-soluble anionic dyes.

More concretely, the water-soluble anionic dyes for the ink for the present invention include:

C.I. direct black-2, -4, -9, -11, -17, -19, -22, -32, -80, -151, -154, -168, -171, -194, and -195;

C.I. direct blue-1, -2, -6, -8, -22, -34, -70, -71, -76, -78, -86, -112, -142, -165, -199, -200, -201, -202, -203, -207, -218, -236, -287, and -307;

C.I. direct red-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, -189, and -227;

C.I. direct violet-2, -5, -9, -12, -18, -25, -37, -43, -66, -72, -76, -84, -92, and -107;

C.I. direct yellow-1, -2, -4, -8, -11, -12, -26, -27, -28, -33, -34, -41, -44, -48, -58, -86, -87, -88, -132, -135, -142, -144, and 173;

C.I. food black-1 and -2;

C.I. acid black-1, -2, -7, -16, -24, -26, -28, -31, -48, -52, -63, -107, -112, -118, -119, -121, -156, -172, -194, and -208;

C.I. acid blue-1, -7, -9, -15, -22, -23, -27, -29, -40, -43, -55, -59, -62, -78, -80, -81, -83, -90, -102, -104, -111, -185, -249, and 254;

C.I. acid red-1, -4, -8, -13, -14, -15, -18, -21, -26, -35, -37, -52, -110, -144, -180, -249, and -257;

C.I. acid yellow-1, -3, -4, -7, -11, -12, -13, -14, -18, -19, -23, -25, -34, -38, -41, -42, -44, -53, -55, -61, -71, -76, -78, -79, and 122; and The dyes having structures shown by the following general formulae (I) and (II):

General Formula (I)

[Chemical formula 1]

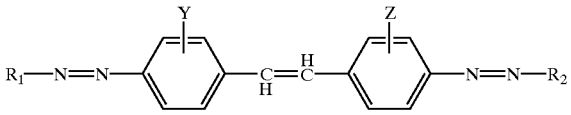

wherein, $R_1$ and $R_2$ are each a group shown by the following formulae (1) and (2), respectively; Y and Z are each hydrogen or —$SO_3M$; and M is a counter ion selected from the group consisting of alkaline metallic, ammonium, substituted ammonium ions,

[Chemical formula 2]

(1)

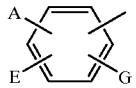

(2)

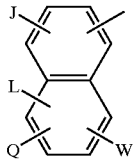

wherein, A, E and G are each selected from the group consisting of hydrogen, an alkyl, —OH and —COOM; J, L, Q and W are each hydrogen and group selected from the group consisting of —OH, —$NH_2$ and —$SO_3M$; and M is a counter ion selected from the group consisting of alkaline metallic, ammonium, substituted ammonium ions, General Formula (II)

[Chemical formula 3]

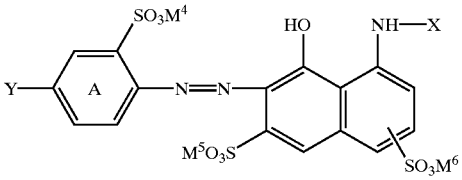

wherein, Y is hydrogen, methyl, methoxy, acetylamino or nitro; which may form a benzene ring together with the carbon atom at the site 3 on benzene ring A; X is acetyl, benzoyl, paratoluene sulfonyl, or 4-chloro-6-hydroxy-1,3,5-triazin-2-yl; and $M^4$, $M^5$ and $M^6$ are each a counter ion selected from the group consisting of alkaline metallic, ammonium, substituted ammonium ions.

These dyes may be used either individually or in combination. Content of the dye in the ink for the present invention is preferably 0.1 to 10 wt. %, based on the whole ink, more preferably 1 to 8 wt. %.

The pigments useful for the ink for the present invention may be organic or inorganic.

More concretely, the black color pigments useful for the present invention include, but not limited to, carbon black pigments, such as furnace black, lamp black, acetylene black and channel black, including Raven7000, Raven5750, Raven5250, Raven5000, ULTRAII, Raven3500, Raven2000, Raven1500, Raven1250, Raven1200, Raven1190 ULTRAII, Raven1170, Raven1255, Raven1080, AND Raven1060 (supplied by Columbian Chemicals Company); Regal400R, Regal330R, Regal1660R, Mogul L, Black Pearls L, Monarch 700, Monarch 800, Monarch 880, Monarch 900, Monarch 1000, Monarch 1100, Monarch 1300, and Monarch 1400 (supplied by provided by Cabot Corp.); Color Black FW1, Color Black FW2, Color Black FW2V, Color Black 18, Color Black FW200, Color Black S150, Color Black S160, Color Black S170, Printex35, PrintexU, PrintexV, Printex140U, Printex140V, Special Black 6, Special Black 5, Special Black 4A, and Special Black 4 (supplied by Degussa AG); No. 25, No. 33, No. 40, No. 47, No. 52, No. 900, and No. 2300, MCF-88, MA600, MA7, MA8, AND MA100 (supplied by Mitubishi Chemical corporation).

The cyan color pigments useful for the present invention include, but not limited to, C.I. Pigment Blue-1, C.I. Pigment Blue-2, C.I. Pigment Blue-3, C.I. Pigment Blue-15, C.I. Pigment Blue-15:1, C.I. Pigment Blue-15:3, C.I. Pigment Blue-15:34, C.I. Pigment Blue-16, C.I. Pigment Blue-22, and C.I. Pigment Blue-60.

The magenta color pigments useful for the present invention include, but not limited to, C.I. Pigment Red-5, C.I. Pigment Red-7, C.I. Pigment Red-12, C.I. Pigment Red-48, C.I. Pigment Red-48:1, C.I. Pigment Red-57, C.I. Pigment Red-112, C.I. Pigment Red-122, C.I. Pigment Red-123, C.I. Pigment Red-146, C.I. Pigment Red-168, C.I. Pigment Red-184, and C.I. Pigment Red-202.

The yellow color pigments useful for the present invention include, but not limited to, C.I. Pigment Yellow-1, C.I. Pigment Yellow-2, C.I. Pigment Yellow-3, C.I. Pigment Yellow-12, C.I. Pigment Yellow-13, C.I. Pigment Yellow-14, C.I. Pigment Yellow-16, C.I. Pigment Yellow-17, C.I. Pigment Yellow-73, C.I. Pigment Yellow-74, C.I. Pigment Yellow-75, C.I. Pigment Yellow-83, C.I. Pigment Yellow-93, C.I. Pigment Yellow-95, C.I. Pigment Yellow-97, C.I. Pigment Yellow-98, C.I. Pigment Yellow-114, C.I. Pigment Yellow-128, C.I. Pigment Yellow-129, C.I. Pigment Yellow-151, and C.I. Pigment Yellow-154.

In addition to pigments of black color and three primary colors of cyan, magenta and yellow, pigments of specific other colors may be used. These colors include red, green, blue, brown and white. Moreover, pigments of metallic luster (e.g., gold and silver), colorless and light-colored extender pigments, and pigments developed for this invention may be also used.

These pigments may be used either individually or in combination. Content of the pigment in the ink for the present invention is preferably 0.5 to 20 wt. %, based on the whole ink, more preferably 2 to 10 wt. %.

(Pigment Dispersant)

It is preferable to use a pigment dispersant, when a pigment is used for the ink for the present invention. The pigment dispersants useful for the ink for the present invention include polymer-based dispersants, and anionic, cationic, ampholytic and nonionic surfactants.

A polymer-based dispersant can be effectively used for the present invention, so long as it has a hydrophilic and hydrophobic structural part. Such polymers include condensed and addition polymers. The condensed polymers include known polyester-based ones, and the addition polymers include those from monomers having an α,β-ethylenic unsaturated group. A desired polymer-based dispersant can be produced by copolymerizing an adequate monomer having a hydrophilic group and α,β-ethylenic unsaturated group with a monomer having a hydrophobic group and α,β-ethylenic unsaturated group. A homopolymer of monomer having a hydrophilic group and α,β-ethylenic unsaturated group can be also used.

The monomers having a hydrophilic group and α,β-ethylenic unsaturated group include, e.g., monomers having a carboxyl, sulfonic, hydroxyl, or phosphoric group, including acrylic acid, methacrylic acid, crotonic acid, itaconic acid, itaconate monoester, maleic acid, maleate monoester, fumaric acid, fumarate monoester, vinyl sulfonate, styrene sulfonate, sulfonated vinyl naphthalene, vinyl alcohol, acrylamide, methacryloxy ethyl phosphate, bismethacryloxy ethyl phosphate, methacryloxy ethyl phenyl acid phosphate, ethylene glycol dimethacrylate, and diethylene glycol dimethacrylate.

The monomers having a hydrophobic group and α,β-ethylenic unsaturated group include styrene derivatives, e.g., styrene, α-methyl styrene, vinyl toluene; and vinyl cyclohexane, vinyl naphthalene, vinyl naphthalene derivative, alkyl acrylate ester, alkyl methacrylate ester, phenyl methacrylate ester, cycloalkyl methacrylate ester, alkyl crotonate ester, dialkyl itaconate ester, and dialkyl maleate ester.

The preferable copolymers include styrene/styrene sulfonate, styrene/maleic acid, styrene/methacrylic acid, styrene/acrylic acid, vinyl naphthalene/maleic acid, vinyl naphthalene/methacrylic acid, vinyl naphthalene/acrylic acid, alkyl acrylate ester/acrylic acid, alkyl methacrylate ester/methacrylic acid, styrene/alkyl methacrylate ester/methacrylic acid, styrene/alkyl acrylate ester/acrylic acid, styrene/phenyl methacrylate ester/methacrylic acid, and styrene/cyclohexyl methacrylate ester/methacrylic acid copolymers. These copolymers may be further copolymerized, as required, with a monomer having a polyoxyethylene or hydroxyl group.

The copolymers useful for the present invention may be of any structure, e.g., random, block or graft. Cellulose derivatives, polysaccharides and their derivatives can be also used. The other polymers useful for the present invention include polystyrene sulfonate, polyacrylate, polymethacrylate, polyvinyl sulfonate, polyalginate, polyoxyethylene/polyoxypropylene/polyoxyethylene block copolymer, naphthalene sulfonate condensed with formalin, polyvinylpyrrolidone, polyethyleneimine, polyamine, polyamide, polyvinylimidazoline, amino alkyl acrylate/acrylamide copolymer, chitosan, polyoxyethylene fatty acid amide, polyvinyl alcohol, polyacrylamide, cellulose derivatives (carboxy methyl and carboxy ethyl cellulose), and polysaccharides and their derivative.

The hydrophilic group of the pigment dispersant is not limited, but preferably acidic. More preferably, it is carboxylic acid or its salt, conceivably because a carboxylic group forms a crosslinked structure with multivalent metallic ion species, to give the pigment an adequately agglomerated structure.

The polymer having an acidic hydrophilic group is preferably used in the form of a salt with a basic compound, to have enhanced solubility in water. The compounds which form salts with these polymers include alkaline metals, e.g., sodium, potassium and lithium; aliphatic amines, e.g., monomethylamine, dimethylamine and trimethylamine; alcohol amines, e.g., monomethanolamine, monoethanolamine, diethanolamine, triethanolamine, and diisopropanolamine; and ammonia. Of these, basic compounds of alkaline metals (e.g., sodium, potassium and lithium) are more preferable, because they are strongly electrolytic, greatly accelerating dissociation of the acidic group.

It is preferable that the pigment dispersant is neutralized to 50% or more of the acid value of the copolymer, more preferably 80% or more.

These pigment dispersants may be used either individually or in combination. The preferable pigment dispersant content widely varies depending on type dispersant used. It is generally 0.1 to 100 wt. % (total content, when two or more types are used), based on the pigment, preferably 1 to 70 wt. %, more preferably 3 to 50 wt. %.

(Anionic Substance)

It is preferable, as described earlier, that the ink for the present invention is incorporated with an anionic substance. The anionic substance in the ink interacts with the cationic substance in the above-described recording medium, to further enhance the effect of inhibiting curling and cockling, and improve image quality and resistance to water. The "anionic substance" useful for the present invention is the substance which is dissociated in water into an organic anion.

The anionic substance is preferably used in the form that the ink contains a dye or pigment having an anionic group, and also an anionic compound.

The pigment dispersant may be used as the anionic substance for the ink for the present invention, when it is of an anionic substance. An anionic compound may be added, when the dispersant is not anionic. Another anionic compound may be added, when the anionic group (e.g., carboxylic or sulfonic) is not directly introduced in the pigment particle surfaces themselves or even when the dispersant is anionic.

The anionic compounds useful for the present invention include acids (e.g., carboxylic and sulfonic acids), their derivatives, and anionic polymer emulsion.

More concretely, the carboxylic acids include formic, acetic, propionic, butyric, valeric, lactic, tartaric, benzoic, acrylic, crotonic, butenoic, methacrylic, tiglic, allyl, 2-ethyl-2-butenoic, oxalic, malonic, succinic, glutaric, maleic, fumaric, methylmaleic and glyceric acids, and polymers thereof and their derivatives. Their salts with, e.g., alkaline metals, alkaline-earth metals and ammonium can be also used.

The sulfonic acids include benzenesulfonate, toluenesulfonate, xylenesulfonate, benzenedisulfonate, benzenetrisulfonate, hydroxybenzenesulfonate, chlorobenzenesulfonate, bromobenzenesulfonate, 4-hydroxy-1,3-benzenedisulfonate, sodium 4,5-dihydroxybenzene-1,3-disulfonate, and o-aminobenzenesulfonate; and their derivatives, and their salts with, e.g., alkaline metals, alkaline-earth metals and ammonium.

These anionic compounds may be used either individually or in combination. Content of the anionic compounds in the ink for the present invention is 0.1 to 10 wt. %, based on the ink, preferably 0.3 to 5 wt. %.

(Surfactant)

The ink for the present invention can be incorporated with a cationic, nonionic or anionic surfactant for various purposes, e.g., adjustment of ink surface tension and wettability, solubilizing organic impurities, and improvement of reliability of ink jet from the nozzle. These surfactants may be used either individually or in combination. Content of the surfactant is preferably 5 wt. % or less, more preferably 0.01 to 3 wt. %.

(Other Components)

The ink for the present invention can be incorporated with, in addition to the above-described components, one or more of the following compounds, to control the ink characteristics. These include polyethyleneimine, polyvinyl pyrrolidone, polyethylene glycol, cellulose derivatives (e.g., ethyl and carboxymethyl cellulose), other water-soluble polymers, polymer emulsion (e.g., acrylic- and polyurethane-based), cyclodextrin, macrocyclic amine, dendrimer, crown ether, urea and its derivative, and acetoamide.

The ink for the present invention may be further incorporated with an alkaline metal compound, e.g., potassium, sodium or lithium hydroxide; nitrogen-containing compound, e.g., ammonium hydroxide, triethanolamine, diethanolamine, ethanolamine, or 2-amino-2-methyl-1-propanol; alkaline-earth metal compound, calcium hydroxide; acid, e.g., sulfuric, hydrochloric or nitric acid; and salt of strong acid and weak alkali, e.g., ammonium sulfate.

The ink for the present invention may be still further incorporated with an additive, as required, e.g., pH buffer, anti-oxidant, fungicide, viscosity-adjuster, electroconductive agent, ultraviolet absorber, chelating agent, water-soluble dye, dispersed dye and oil-soluble dye.

2. Preparation of Ink

The ink of the above composition can be prepared by mixing the components with sufficient stirring, when it is dye-based. When it is pigment-based, a given quantity of the pigment is added to an aqueous solution, which is incorporated with a pigment dispersant, as required. The mixture is then sufficiently stirred, treated by a disperser for dispersing the pigment, treated by a centrifugal separator or the like to remove the coarse particles, incorporated with a given solvent, additive(s) and the like with stirring, and filtered. The pigment-based ink may be prepared by other methods, e.g., solution in which the pigment is dispersed at a high concentration is prepared and diluted before use. A crushing step may be adopted prior to the step of dispersing the pigment.

Any type of commercial machine may be used for dispersing the pigment, e.g., colloid mill, flow jet mill, slasher mill, high-speed disperser, ball mill, attritor, sand mill, sand grinder, ultrafine mill, Eiger motor mill, Dyno mill, pearl mill, agitator mill, Cobol mill, 3-roll mill, 2-roll mill, extruder, kneader, microfluidizer, laboratory homogenizer, and ultrasonic homogenizer. These machines may be used either individually or in combination. The pigment may be dispersed in a mixture of a given solvent, water and pigment dispersant by an adequate disperser. A dispersion method which uses no dispersing medium is preferable, viewed from prevention of contamination with an inorganic impurity, for which suitable dispersers include microfluidizer and ultrasonic homogenizer.

Ink pH level is not limited, but preferably 3 to 11, more preferably 4.5 to 9.5. The ink which has an anionic free radical on the pigment surface preferably has a pH level of 6 to 11, more preferably 6 to 9.0, still more preferably 7.5 to 9.0. On the other hand, the ink which has a cationic free radical on the pigment surface preferably has a pH level of 4.5 to 8.0, more preferably 4.5 to 7.0.

[Ink-jet Recording Method]

The ink-jet recording method of the present invention is characterized in that it forms a recording image by applying the above-described ink on the recording medium, also above-described. More concretely, the image is formed on the medium with the ink droplets discharged from the orifice according to recording signals.

Various methods can be used for the present invention, including the so-called charge-controlled type which uses elects static attraction force to discharge the ink, pressure-pulse type which uses vibrational pressure produced by a piezo device to discharge the ink, and thermal ink-jet type which uses pressure, produced by heating ink to form and grow the bubbles, to form the ink droplets, of which the last type is more preferable for its ability to produce full-color images at low cost by a compact unit.

[Ink-jet Printer]

The ink-jet printer of the present invention is provided with a transfer device that transfers a recording medium, an ink-jet recording head that ejects an ink onto the medium transferred by the transfer device to form an image thereon, and an image signal inputting device that inputs an image signal to the ink-jet recording head, wherein the ink-jet recording method of the present invention is applied.

In other words, the ink-jet printer of the present invention, provided with the above devices, uses the above-described recording medium and ink for the present invention.

The transfer device that transfers the recording medium, ink-jet recording head and image signal inputting device for the ink-jet printer of the present invention are not limited, each being selected from the commercial ones. In any way, the effects of the present invention can be produced, when the above-described recording medium and ink for the present invention are used.

EXAMPLES

The present invention is described in more detail by Examples.

[Production of Recording Medium]

(Recording Medium-1)

FX-L paper (provided by Fuji Xerox Co., Ltd.) was immersed in a recording medium coating solution, with the following components mixed and dissolved for dip coating. The coated paper was naturally dried, to produce the recording medium-1. It contained the specific organic compound at 20 g/cm$^2$.

(Components of the Recording Medium Coating Solution)

D-mannose (as the specific organic compound): 30 wt. parts

Ion-exchanged water: Balance

Total: 100 wt. parts (Recording Medium-2)

FX-L paper (provided by Fuji Xerox Co., Ltd.) was immersed in a recording medium coating solution, with the following components mixed and dissolved for dip coating. The coated paper was naturally dried, to produce the recording medium-2. It contained the specific organic compound at 15 g/cm$^2$, and cationic substance at 5 g/cm$^2$.

(Components of the Recording Medium Coating Solution)

D-xylose (as the specific organic compound): 30 wt. parts

Chitosan/oligosaccharide lactate (as the cationic substance): 10 wt. parts

Ion-exchanged water: Balance

Total: 100 wt. parts (Recording Medium-3)

FX-L paper (provided by Fuji Xerox Co., Ltd.) was immersed in a recording medium coating solution, with the following components mixed and dissolved for dip coating. The coated paper was naturally dried, to produce the recording medium-3. It contained the specific organic compound at 18 g/cm$^2$, cationic substance at 4 g/cm$^2$, and fine, inorganic particles at 6 g/cm$^2$.

(Components of the Recording Medium Coating Solution)

Xylitol (as the specific organic compound): 30 wt. parts

Polyallylamine (as the cationic substance, molecular weight: approximately 1,000): 8 wt. parts Light calcium carbonate (as the fine, inorganic particles, trade name: PC, Shiraishi Kogyo): 10 wt. parts Ion-exchanged water: Balance Total: 100 wt. parts (Recording Medium-4)

FX-L paper (provided by Fuji Xerox Co., Ltd.) was immersed in a recording medium coating solution, with the following components mixed and dissolved for dip coating. The coated paper was naturally dried, to produce the recording medium-4. It contained the specific organic compound at 18 g/cm$^2$, cationic substance at 5 g/cm$^2$ (total content), and fine, inorganic particles at 6 g/cm$^2$.

(Components of the Recording Medium Coating Solution)

1,1,1-Tris(hydroxylmethyl)propane (as the specific organic compound): 30 wt. parts Hexadecyldimethylamine hydrochloride (as the cationic substance): 6 wt. parts Calcium nitrate (as the cationic substance): 2 wt. parts Fine, amorphous silica (as the fine, inorganic particles, trade name: Fineseal, provided by Tokuyama Corp.): 10 wt. parts Ion-exchanged water: Balance Total: 100 wt. parts (Recording Medium-5)

FX-L paper (provided by Fuji Xerox Co., Ltd.) was immersed in a recording medium coating solution, with the following components mixed and dissolved for dip coating. The coated paper was naturally dried, to produce the recording medium-5. It contained the specific organic compound at 18 g/cm$^2$, cationic substance at 6 g/cm$^2$, and fine, inorganic particles at 5 g/cm$^2$.

(Components of the Recording Medium Coating Solution)

Glucose (as the specific organic compound): 30 wt. parts

Polyallylamine hydrochloride (as the cationic substance, molecular weight: approximately 10,000): 8 wt. parts Light calcium carbonate (as the fine, inorganic particles, trade name: Brilliant-15, Shiraishi Kogyo): 10 wt. parts Ion-exchanged water: Balance Total: 100 wt. parts (Recording Medium-6)

FX-L paper (Provided by Fuji Xerox Co., Ltd.) was immersed in a recording medium coating solution, with the following components mixed and dissolved for dip coating. The coated paper was naturally dried, to produce the recording medium-6. It contained glycerin at 20 g/cm$^2$.

(Components of the Recording Medium Coating Solution)

Glycerin: 30 wt. parts

Ion-exchanged water: Balance

Total: 100 wt. parts (Recording Medium-7)

FX-L paper (Provided by Fuji Xerox Co., Ltd.) was immersed in a recording medium coating solution, with the following components mixed and dissolved for dip coating. The coated paper was naturally dried, to produce the recording medium-7. It contained diethylene glycol at 28 g/cm$^2$.

(Components of the Recording Medium Coating Solution)

Diethylene glycol: 30 wt. parts

Surfactant (Surfinol 465, provided by Nisshin Chemical Industry Co., Ltd.): 1 wt. part Ion-exchanged water: Balance Total: 100 wt. parts

[Preparation of Ink]

(Ink-1 to Ink-4)

The composition, with the following components mixed and dissolved, was filtered under pressure by a 0.45 $\mu$m filter, to prepare the ink-1 to ink-4.

(Composition of Ink-1)

C.I. direct black 17 (water-soluble dye having an anionic group): 5 wt. parts

Glycerin: 10 wt. parts

Surfactant (Nonion E-230, provided by NOF corp.): 0.03 wt. parts

Isopropyl alcohol: 3 wt. parts

Ion-exchanged water: Balance

Total: 100 wt. parts (Composition of Ink-2)

C.I. acid blue-9 (water-soluble dye having an anionic group): 5 wt. parts

Diethylene glycol: 20 wt. parts

Butyl carbitol: 5 wt. parts

Urea: 6 wt. parts

Ion-exchanged water: Balance

Total: 100 wt. parts (Composition of Ink-3)

C.I. acid red52 (water-soluble dye having an anionic group): 5 wt. parts

Ethylene glycol: 20 wt. parts

Surfactant (Surfinol 465, provided by Nisshin Chemical Industry Co., Ltd.): 0.5 wt. parts Ion-exchanged water: Balance Total: 100 wt. parts (Composition of Ink-4)

C.I. direct yellow-86 (water-soluble dye having an anionic group): 3 wt. parts 1,5-Pentanediol: 20 wt. parts Surfactant (Nonion E-230, provided by NOF corp.): 1 wt. part Ion-exchanged water: Balance Total: 100 wt. parts (Ink-5)

Carbon black (Black Pearls L, provided by Cabot Corp.) was dissolved in ion-exchanged water incorporated with 3 wt. parts of sodium-neutralized salt of styrene/maleic acid copolymer by a ultrasonic homogenizer, and treated by a centrifugal separator to remove the residue. The supernatant liquid was passed through a 1 $\mu$m filter, to prepare a dispersed solution.

An adequate quantity of the above dispersed solution was incorporated with adequate quantities of glycerin, diethylene glycol monobutyl ether, a surfactant, isopropyl alcohol, ion-exchanged water and sodium hydroxide, to have a carbon black content of 5 wt. %. The solution was stirred for mixing, and passed through a 1 $\mu$m filter, to prepare the ink-5 of the following composition.

(Composition of Ink-5)

Carbon black (Black Pearls L, Cabot): 5 wt. %

Styrene/maleic acid/sodium maleate copolymer: 0.3 wt. %

Glycerin: 10 wt. %

Diethylene glycol monobutyl ether: 5 wt. %

Surfactant (Nonion E-230, provided by NOF corp.): 0.03 wt. parts,

Isopropyl alcohol: 3 wt. parts

Ion-exchanged water: Balance

Total: 100 wt. parts

Examples 1 to 10, and Comparative Examples 1 to 6

Images were recorded by a thermal ink-jet printer in Examples and Comparative Examples. Combinations of the recording medium and ink are given in Table 1, where "common paper" means FX-L paper (provided by Fuji Xerox Co., Ltd.). The printer, made on a trial basis, had 400 dpi and 160 nozzles (hereinafter referred to as the printer made on a trial basis) to eject each ink onto each recording medium.

[Evaluation Methods]

Images (100% coverage pattern and line pattern types) were recorded on each recording medium by the printer made on a trial basis, with the ink cartridge filled with each ink, and the printed medium was allowed to stand under normal environments (temperature: 23° C.±0.5° C. and relative humidity: 55±5%) for 24 hours.

The medium printed with the 100% coverage pattern type images was used to evaluate its resistance to curling and water, and the one printed with the line pattern type images was used to evaluate bleeding of the images. The recording medium, immediately after it was printed with the 100% coverage pattern type images, was evaluated for its resistance to cockling and drying capacity. The printing and evaluation were effected under normal environments (temperature: 23° C.±0.5° C. and relative humidity: 55±5%), unless otherwise described.

(Evaluation of Curling)

The recording medium, printed with the 100% coverage pattern type images was placed on a flat plane, and turning-up heights at the four corners were measured, to evaluate curling by the averaged heights. The evaluation criteria are described below:

◎: below 5 mm

○: 5 mm or more, but below 10 mm

Δ: 10 mm or more, but below 20 mm

X: 20 mm or more (Evaluation of Cockling)

Heights of creases on the recording medium, immediately after it was printed with the 100% coverage pattern type images, were measured to evaluate cockling.

The evaluation criteria are described below:

○: below 1 mm

Δ: 1 mm or more, but below 3 mm

X: 3 mm or more (Evaluation of Resistance to Water)

The recording medium printed with the 100% coverage pattern type images was evaluated for resistance of the image to water, where optical concentration of the 100% coverage pattern section was measured by an X-Rite 404 (provided by X-Rite, Inc.), and the medium was immersed in water for 3 min, withdrawn from water and dried, to be measured for the optical concentration of the 100% coverage pattern section. Residual concentration ratio was measured as the index for resistance to water. The evaluation criteria are described below:

○:Residual concentration ratio: 90% or more

Δ: Residual concentration ratio: 70% or more but below 90%

X: Residual concentration ratio: below 70%

(Evaluation of Drying Capacity)

A sheet of FX-L paper (provided by Fuji Xerox Co., Ltd.) was placed on the recording medium, immediately after it was printed with the 100% coverage pattern type images, and a load of 100 g/cm$^2$ was applied to the FX-L paper, to measure time until the ink was no longer transferred to the FX-L paper (time elapsing from printing to placing the paper on the printed medium). The evaluation criteria for drying capacity are described below:

○: below 5 sec

Δ: 5 sec or more, but below 10 sec

X: 10 sec or more

The evaluation results are summarized in Table 1.

TABLE 1

| | Combinations of recording medium and ink | | Evaluation results | | | | |
|---|---|---|---|---|---|---|---|
| | Recording medium | Ink | Curling | cockling | Image bleeding | Resistance to water | Drying capacity |
| Example 1 | 1 | 1 | ○ | ○ | ○ | Δ | Δ |
| Example 2 | 1 | 2 | ○ | ○ | Δ | Δ | ○ |
| Example 3 | 2 | 3 | ◎ | ○ | ○ | ○ | ○ |
| Example 4 | 2 | 4 | ◎ | ○ | ○ | ○ | ○ |
| Example 5 | 3 | 2 | ◎ | ○ | ○ | ○ | ○ |
| Example 6 | 3 | 5 | ◎ | ○ | ○ | ○ | ○ |
| Example 7 | 4 | 1 | ◎ | ○ | ○ | ○ | ○ |
| Example 8 | 4 | 4 | ◎ | ○ | ○ | ○ | ○ |
| Example 9 | 5 | 3 | ◎ | ○ | ○ | ○ | ○ |
| Example 10 | 5 | 5 | ◎ | ○ | ○ | ○ | ○ |
| Comparative Example 1 | 6 | 1 | X | X | Δ | X | X |
| Comparative Example 2 | 6 | 3 | X | X | X | X | ○ |
| Comparative Example 3 | 7 | 2 | Δ | Δ | X | X | ○ |
| Comparative Example 4 | 7 | 5 | Δ | Δ | Δ | ○ | X |
| Comparative Example 5 | Common paper | 1 | X | X | ○ | X | X |
| Comparative Example 6 | Common paper | 4 | X | X | X | X | ○ |

(Evaluation of Image Bleeding)

The organoleptic examination was conducted to evaluate image bleeding with the recording medium printed with the line pattern type images by comparing the image with the reference for the predetermined bleeding extent. The evaluation criteria are described below:

○: No bleeding

Δ: Bleeding to an acceptable extent

X: Bleeding to an unacceptable extent

Effects of the Invention

As described above, the present invention provides the ink-jet recording method and ink-jet printer, which can diminish or control curling and cockling of the recording medium by including a specific organic compound in the medium.

The ink-jet recording method and ink-jet printer of the present invention can form a recorded image of high quality, resistance to water and drying capacity, while diminishing or controlling curling and cockling more efficiently, by including a cationic substance in the recording medium and anionic substance in the ink.

What is claimed is:

1. An ink-jet recording method comprising:

forming a recording image on a surface of a recording medium including at least one organic compound and at least one cationic substance;

applying an ink including at least a colorant, a water-soluble organic solvent, an anionic substance, and water on the recording medium;

wherein the organic compound is selected from a group consisting of 1,1,1-tris(hydroxylmethyl)propane, monosaccharides, oligosaccharides, and sugar alcohols and the cationic substance is selected from a group consisting of cationic surfactants, cationic polymers, and multivalent metallic salts.

2. An ink-jet printer comprising:

a transfer device that transfers a recording medium;

an ink-jet recording head that ejects an ink onto the recording medium transferred by the transfer device to record an image thereon; and an image signal inputting device that sends an image signal to the ink-jet recording head;

wherein the recording medium includes at least one organic compound selected from a group consisting of 1,1,1-tris(hydroxylmethyl)propane, monosaccharides, oligosaccharides, and sugar alcohols and at least one cationic substance selected from a group consisting of cationic surfactants, cationic polymers, and multivalent metallic salts; and the ink includes at least a colorant, a water-soluble organic solvent, an anionic substance, and water.

3. An ink-jet recording method according to claim 1, wherein the anionic substance is an aqueous dye having an anionic group.

4. An ink-jet recording method according to claim 1, wherein the recording medium including inorganic particle.

5. An ink-jet recording method according to claim 2, wherein the anionic substance is an aqueous dye having an anionic group.

6. An ink-jet recording method according to claim 2, wherein the recording medium including inorganic particle.

* * * * *